United States Patent [19]

Johnson et al.

[11] Patent Number: 4,777,878

[45] Date of Patent: Oct. 18, 1988

[54] EXPLODING BRIDGE WIRE DETONATOR WITH SHOCK REFLECTOR FOR OIL WELL USAGE

[75] Inventors: James O. Johnson, Los Alamos, N. Mex.; James M. Barker, Katy; Starlin M. Reid, Porter, both of Tex.

[73] Assignee: Halliburton Company, Duncan, Okla.

[21] Appl. No.: 99,375

[22] Filed: Sep. 14, 1987

[51] Int. Cl.[4] ..... E42B 3/12

[52] U.S. Cl. ..... 102/202.5

[58] Field of Search ..... 102/202.5, 202.7, 305, 102/306, 309, 318, 322, 475, 476

[56] References Cited

U.S. PATENT DOCUMENTS

| | | | |
|---|---|---|---|
| 2,900,905 | 8/1959 | MacDougall | 102/306 |
| 3,404,600 | 10/1968 | Bilek | 102/476 |
| 4,050,381 | 9/1977 | Heinemann | 102/476 |
| 4,368,670 | 1/1983 | Weidner | 102/202.5 |
| 4,594,946 | 6/1986 | Ringel et al. | 102/309 |
| 4,735,145 | 4/1988 | Johnson et al. | 102/202.5 |

*Primary Examiner*—Charles T. Jordan

*Attorney, Agent, or Firm*—William J. Beard

[57] ABSTRACT

An exploding bridge wire detonator for use in high temperature downhole oil well tools is set forth. It is made of a high temperature stable secondary explosive which will be exposed to extremely high ambient temperatures such as 500° F. This apparatus includes a housing supporting a pair of conductor wires which connect with a sacrificial exploding bridge foil or wire connected across the conductor wires. The sacrificial bridge is immediately adjacent to the explosive material in cylindrical form, and a reflector is included therein. The reflector preferably has high shock impedance to reflect shock waves traveling through the explosive from the exploding bridge. The reflector is transverse to the explosive mass but does not fully block off explosive shock wave propagation through the explosive material.

14 Claims, 1 Drawing Sheet

FIG. 1
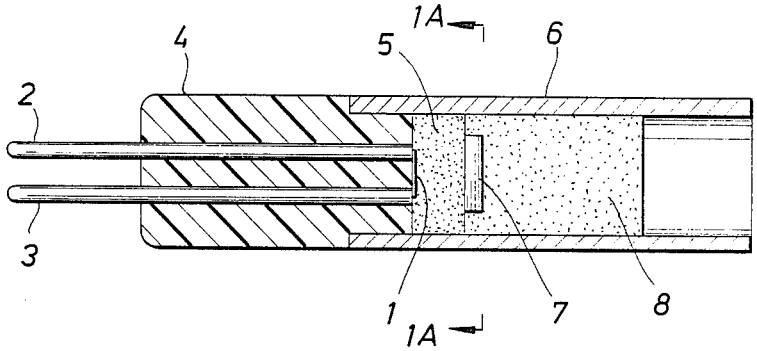
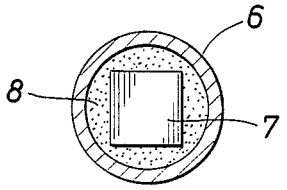
FIG. 1A
FIG. 2
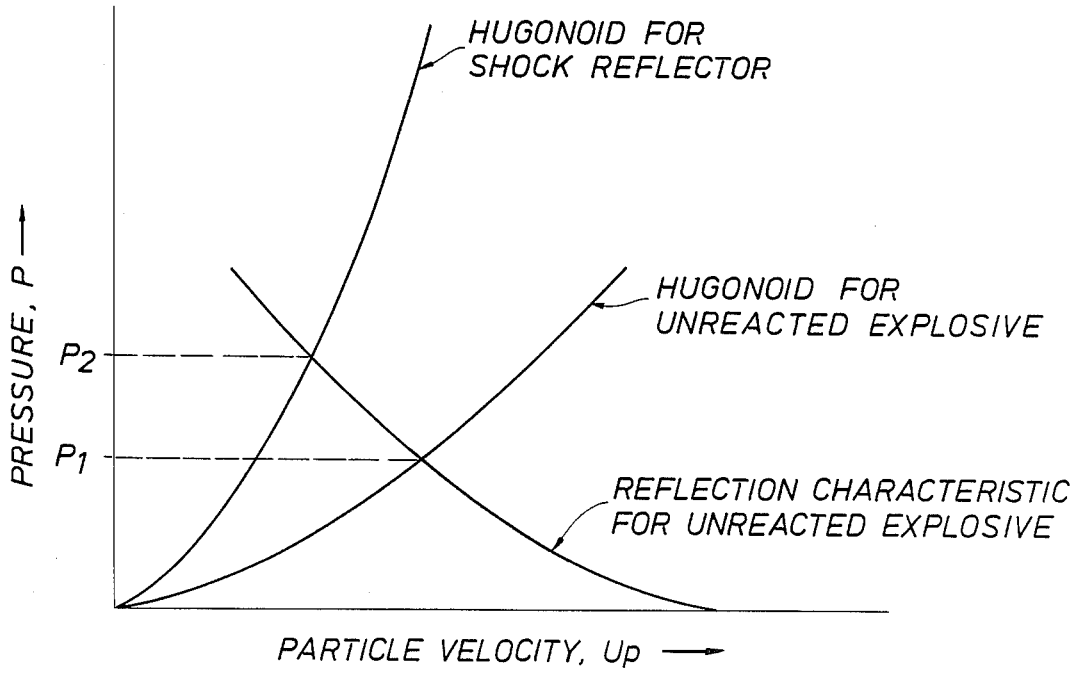

EXPLODING BRIDGE WIRE DETONATOR WITH SHOCK REFLECTOR FOR OIL WELL USAGE

BACKGROUND OF THE INVENTION

This invention relates to oil well perforating and more particularly to high temperature detonators for use in oil well perforating with shaped charges in high temperature boreholes.

As oil wells have become deeper and more expensive to drill it has also become more difficult to perforate cemented casing in order to place the well on production due to the high temperature encountered near the bottom of boreholes in the deep wells. It is not uncommon in oil and gas production in the United States at at the present time to encounter wells from 16,000 to 22,000 feet in depth routinely which wells can have borehole bottom temperatures ranging from 300° to 500° F. dependent on the temperature gradient at the particular location of the well.

Conventional shaped charge perforating devices have relied upon detonators or initiators utilizing a primary explosive therein which may be detonated by heat or shock wave or a combination of both. Typically, an initiator charge or booster charge in a detonator will have a primary high explosive which may be heat initiated by a heating element which is activated by passing an electrical current therethrough. The electrical heating element heats the primary explosive in its immediate vicinity (usually in contact) and causes the detonation of this explosive which then propagates a shock wave through the surrounding explosive detonating it. The detonation of the initiator or detonator cap is then usually transmitted to a particular shaped charge explosive or explosive string by the use of detonating cord which connects the electricity activated initiator to each individual shaped charge in a string or gun which is being used to perforate a section of casing in a cased well borehole in order to provide entry ports for fluid production from the surrounding earth formations.

At the high temperatures encountered in wells being drilled and produced at the present time, however, the use of conventional primary explosives can become hazardous for two reasons. The explosives themselves become unstable at the elevated temperatures encountered near the bottoms of deep well boreholes. Also, there is always the possibility of forming stray electrical currents in the casing or the electrical wireline used for lowering the perforating gun into the section of casing to be perforated. Such currents can cause premature detonation of the very sensitive primary explosive where even small or slight electrical currents flow through the heating element of conventional detonators or blasting caps heretofore in common usage.

Because of the foregoing problems, it would be desirable to utilize all secondary explosives in the detonating caps or blasting caps for initiating the shaped charge explosives used for well perforating which are less sensitive to heat and other stimuli such as friction, sparks, impact, and static discharge. The more stable or less sensitive secondary explosives which can be obtained having relative heat immunity from degradation up to 600° F. are more difficult to initiate or detonate than the conventional explosives in common usage in well perforating heretofore. The more thermally stable secondary explosives which are desirable for use in high temperature boreholes are more difficult to initiate. This is particularly so in the case of secondary explosives used in the blasting cap or detonator itself which may be utilized for this purpose. A safety feature which may be utilized in well perforating systems for use in high temperature boreholes therefore may comprise a relatively stable secondary explosive such as NONA (or generically 2,2',2'',4,4',4'',6,6',6''—nonanitroterphenyl). Alternatively, a high temperature stable secondary explosive such as HNS-1 (or generically 2,2',4,4',6,6'—hexanitrostilbene) could be used if desired.

Relatively stable secondary explosives such as NONA or HNS-1 may be detonated by the action of a type of detonator known as an exploding bridge detonator. In the exploding bridge type detonator, a conductive bridge having a relatively high current resistance is placed between two electrodes made of a good electrical conductor such as copper and which are connected to a source of electrical power. A relatively high voltage, short duration pulse of electrical energy is supplied to the two good conducting electrodes. The bridge portion of the device between the two relatively good current carrying electrodes is not capable of handling the high intensity short duration pulse of electrical energy and it heats rapidly and literally explodes from the passage of this current through it. The shock wave generated by the explosive of the bridging conductor is propagated through the surrounding medium of the secondary explosive material which is relatively stable at high temperature and used to initiate or detonate this secondary explosive. This technique thus avoids the problem of the use of heater type electrodes for initiation of the explosive material because a relatively higher intensity electrical pulse is required than could be accidentally obtained by the action of stray currents in the casing and wirelines used to support the well perforating instruments.

The use of relatively stable secondary explosives for the detonating cap or initiators has the disadvantage, however, that the relative difficulty of initiating this relatively stable secondary explosive in itself produces unreliable results when performed in the manner common to known prior art exploding bridge detonator type devices. The electrical impulses, foils and wire bridges previously used simply do not contain enough explosive capacity to reliably detonate a relatively stable secondary explosive such as NONA with acceptable reliability standards. An exploding bridge detonator device according to the concepts of the present invention can provide a safe and yet reliable configuration for the use of stable secondary explosives such as NONA as an initiator or some other equally or more stable secondary explosive.

BRIEF DESCRIPTION OF THE INVENTION

In the present invention a relatively stable at high temperature secondary explosive such as NONA is used in an exploding bridge detonator device to provide a reliable detonator for the use in oil well perforating in high temperature wells. A conventional two electrode arrangement is provided in the detonator of the present invention and having a relatively conventional exploding bridge conductor between the two electrodes. The exploding bridge is located at one end of a column of the high temperature stable secondary explosive used in the device. Within the column of high temperature stable secondary explosive and spaced a predetermined distance away from the exploding bridge portion of the detonator is a shock reflector element comprised on an inert but relatively dense material having a high shock wave impedance. The cooperative action of the exploding bridge and the shock reflector intensifies the shock wave propagated through the relatively stable high temperature secondary explosive and causes reliable detonation because of this intensification. Thus by use of the shock reflecting element, the column of high temperature stable secondary explosive is initiated and the detonator of the present invention provides a reliable means for initiating shaped charge perforating guns in high temperature boreholes.

BRIEF DESCRIPTION OF THE DRAWINGS

The foregoing and other features and advantages of the present invention may be better understood by reference to the following detailed description thereof when taken in conjunction with the accompanying drawings. It will be understood by those skilled in the art that the accompanying drawings are merely suggestive in nature of a preferred embodiment of the invention and are not to be considered as limitative on the scope of the invention which is defined in the appended claims.

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In The Drawings

FIG. 1 is a schematic view in longitudinal section showing an exploding bridge detonator according to concepts of the present invention;

FIG. 1A is a cross-section view of the detonator of FIG. 1 at point A in its construction; and FIG. 2 is a graphical relationship illustrating pressure relationships in a column of high temperature stable secondary explosive and relating the pressure at a point in this column to the particle velocity at this point in the column of explosive.

DESCRIPTION OF THE PREFERRED EMBODIMENT

Copending U.S. patent application Ser. No. 069,741 filed July 6, 1987, and assigned to the assignee of the present invention, describes a through bulkhead explosive initiator for oil well usage. It will be appreciated by those skilled in the art that the exploding bridge detonator of the present invention could be utilized in such a system.

Referring initially to FIG. 1, a conductive bridge 1 which may be either a round cross-section or flat cross-section conductor is placed across two electrodes 2 and 3 which are mounted in an insulating header 4. The insulating header 4 may comprise a high temperature plastic or other suitable high temperature insulating material. An amount of relatively stable high temperature secondary explosive 5 such as NONA is placed on top of the bridge 1 such that a short column is formed inside the sleeve 6. A shock reflector 7 is positioned on top of the explosive column 5 and then additional high temperature stable secondary explosive 8 is placed above the shock reflector to continue the column of high temperature stable secondary explosive. The shock reflector 7 may comprise a high shock impedance stainless steel or tungsten material which is configured such that detonation can pass from the first explosive layer 5 to the continuation of the explosive column 8. Such a configuration may be accomplished as shown in the cross-section view of FIG. 1A by making the reflector 7 have a square shape so that it fits within the circular cross-section of the sleeve 6 as shown in FIG. 1A. This leaves an amount of explosive material surrounding the edges of the square reflector 7 which will propagate the detonation of the secondary explosive column 5 and 8. Alternatively, the reflector 7 could be made with small holes around its periphery, for example, to allow the detonation to propagate through the secondary explosive column surrounding the reflector 7.

In operation, a high energy electrical pulse having a high voltage and current amplitude is passed via the electrodes 2 and 3 through the bridge 1 which heats very rapidly such that the bridge 1 explodes or bursts. This bursting action causes a shock wave at some pressure $P_1$ to form which passes through the initial layer 5 of the high temperature stable secondary explosive. This initial shock pressure wave $P_1$ is often not highly dependable enough to initiate relatively insensitive secondary high explosives. The shock wave at initial pressure $P_1$ subsequently impinges upon the reflector 7 which has a higher shock wave impedance than the secondary explosive layer 8 and 5 surrounding it. This is illustrated by the graphic relationship of FIG. 2.

The graphical representation of this process shown in FIG. 2 describes the transmission of a shock wave from a low shock impedance material such as the high temperature stable explosive into a material of higher shock wave impedance, namely the reflector 7. The magnitude of the reflected shock wave is now sufficient to cause the initiation of the explosive layer 5. The resulting detonation shock wave propagates around the reflector 7 and initiates the additional explosive in the column 8.

By choosing reflectors having a very high shock impedance such as tungsten, the reflected pressure $P_2$ can be maximized. This is advantageous since the initiation threshold of many secondary explosives is a strong function of the shock pressure passing through the explosive. It should also be noted that if the reflected shock pressure, $P_2$, is not sufficiently strong to cause prompt detonation of the explosive 5, it may be strong enough to allow a deflagration to begin. The deflagration is allowed to propagate around the shock reflector 7 and rapidly build to a detonation. Thus, the shock reflector principle also enhances the reliability of deflagration-to-detonation transition (DDT) devices.

Experimentation has shown the exploding bridge detonator design hereinbefore described to be reliable. Typical dimensions for the bridge 1 could be a flat copper bridge wire 0.010 inches width by 0.053 inches in length. A stainless steel or tungsten reflector 0.030 inches thick can be spaced approximately 0.08 inches above the flat bridge wire. The density of the relatively high temperature stable secondary explosive is approximately 0.7 grams per cubic centimeter.

The foregoing description may make other alternative embodiments of the invention apparent to those of skill in the art. It is therefore the aim of the appended claims to cover all such changes and modifications as fall within the true spirit and scope of the invention.

What is claimed is:

1. For use in a downhole oil tool exposed to high temperatures, a bridge wire detonator comprising:

(a) a two electrode electrical current system connected to a sacrificial bridge element thereacross for creating a momentary, electrically initiated initial shock wave therefrom;

(b) a solid mass of high temperature stable secondary explosive sufficiently contacted with said bridge element to receive a substantial shock wave therefrom; and (c) a shock wave reflector cooperatively positioned relative to said sacrificial bridge element to reflect the shock wave back across said explosive after creation of the shock wave thereby adding to the pressure of said initial shock wave and increasing the shock pressure in said explosive wherein detonation of said explosive occurs.

2. The apparatus of claim 1 wherein said two electrode system and sacrificial bridge was supported in an insulating header which positions said electrodes immediately adjacent to said sacrificial bridge, and said sacrificial bridge is abutted against one end of a column of said explosive.

3. The apparatus of claim 2 wherein an enclosure surrounds said explosive, and said explosive has the shape of an elongate cylindrical body with said reflector located therein.

4. The apparatus of claim 3 wherein said reflector is a high impedance reflector positioned transversely across said cylindrical explosive mass for reflection of the shock wave.

5. The apparatus of claim 4 wherein said reflector blocks part but not all of the cross-sectional area of said explosive, thereby permitting explosive propagation past said reflector, and wherein said reflector is a high shock impedance material.

6. The apparatus of claim 5 wherein said reflector is a metal.

7. The apparatus of claim 6 wherein said bridge is a flat copper strip and the shock impedance of said explosive is substantially less than the shock impedance of said reflector.

8. The apparatus of claim 1 including an elongate cylindrical housing of circular cross-section formed within a sleeve and said explosive is an elongate cylindrical mass placed therein, and said sacrificial bridge is located at one end of said explosive and said reflector is integrally enclosed within said explosive.

9. The apparatus of claim 8 wherein said reflector is tungsten or stainless steel, or other high shock impedance material.

10. An explosive initiator for use in high temperature downhole oil well environments, comprising:

(a) a sacrificial bridge element connecting two current carrying electrodes and explosively responsive to a high intensity electrical pulse for creating an initial shock wave;

(b) a mass of high temperature stable secondary explosive in contact with said sacrificial bridge element and capable of propagating said initial shock wave; and (c) a shock wave reflective element longitudinally spaced from said sacrificial element and in contact with said mass of said high temperature stable secondary explosive in such a manner that said initial shock wave is reflected from said reflective element and increases the pressure in said initial shock wave to a degree sufficient to cause at least deflagration in said high temperature stable secondary explosive.

11. The apparatus of claim 10 wherein any deflagration caused in said high temperature stable secondary explosive is allowed to propagate around said shock wave reflective element and thereby rapidly build to a detonation of said high temperature stable secondary explosive.

12. The apparatus of claim 11 wherein said reflective element is shaped to permit any deflagration or detonation caused in said high temperature stable secondary explosive to propagate around it.

13. The apparatus of claim 10 wherein said reflective element comprises a high shock impedance reflector positioned transversely at least partially across a cylindrical column of high temperature stable secondary explosive.

14. The apparatus of claim 13 wherein said reflective element comprises a metallic element having a relatively high density in comparison with the density of said secondary explosive.

* * * * *